US010161214B2

(12) United States Patent
Wong et al.

(10) Patent No.: US 10,161,214 B2
(45) Date of Patent: Dec. 25, 2018

(54) OFF-SET TUBING STRING SEGMENTS FOR SELECTIVE LOCATION OF DOWNHOLE TOOLS

(71) Applicant: Halliburton Energy Services, Inc., Houston, TX (US)

(72) Inventors: Daniel Lorng Yon Wong, Singapore (SG); Nicholas Kok Jun Sim, Singapore (SG); Vijay Kumar Keerthivasan, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 329 days.

(21) Appl. No.: 14/889,087

(22) PCT Filed: Sep. 30, 2014

(86) PCT No.: PCT/US2014/058293
§ 371 (c)(1),
(2) Date: Nov. 4, 2015

(87) PCT Pub. No.: WO2016/053297
PCT Pub. Date: Apr. 7, 2016

(65) Prior Publication Data

US 2016/0251929 A1 Sep. 1, 2016

(51) Int. Cl.

| | |
|---|---|
| ***E21B 33/12*** | (2006.01) |
| ***E21B 43/14*** | (2006.01) |
| ***E21B 33/10*** | (2006.01) |
| ***E21B 34/14*** | (2006.01) |
| *E21B 43/16* | (2006.01) |
| *E21B 43/26* | (2006.01) |

(52) U.S. Cl.
CPC ..... *E21B 33/12* (2013.01); *E21B 33/10* (2013.01); *E21B 34/14* (2013.01); *E21B 43/14* (2013.01); *E21B 43/16* (2013.01); *E21B 43/26* (2013.01)

(58) Field of Classification Search
CPC ..... E21B 33/10
See application file for complete search history.

(56) References Cited

U.S. PATENT DOCUMENTS 4,508,166 A * 4/1985 Becker ..... E21B 23/03 166/117.5
5,377,750 A 1/1995 Arterbury et al.
(Continued)

OTHER PUBLICATIONS

International Search Report and Written Opinion dated Jun. 29, 2015; PCT International Application N.: PCT/US2014/058293.

*Primary Examiner* — Giovanna C. Wright
*Assistant Examiner* — Brandon M Duck
(74) *Attorney, Agent, or Firm* — McGuireWoods LLP

(57) ABSTRACT

A system and method for selective isolation of multiple wellbore intervals that can include an isolation mandrel interconnected in a tubing string, where the isolation mandrel includes an entry bore, a transition chamber, and an exit bore, the transition chamber being positioned between the entry and exit bores, and the transition chamber being radially enlarged relative to the entry and exit bores. An isolation device, with a predetermined length, is displaced through the tubing string to the isolation mandrel, where the length of the isolation device relative to a length of the isolation mandrel can determine if the isolation device passes through the isolation mandrel or lands in the isolation mandrel.

22 Claims, 11 Drawing Sheets

(56) References Cited

U.S. PATENT DOCUMENTS

| | | | | |
|---|---|---|---|---|
| 8,167,047 | B2 | 5/2012 | Themig et al. | |
| 8,668,018 | B2 | 3/2014 | Fay | |
| 2007/0158062 | A1 | 12/2007 | Heller et al. | |
| 2011/0036594 | A1* | 2/2011 | Yokley | E21B 17/06 166/382 |
| 2011/0240301 | A1 | 10/2011 | Robison et al. | |
| 2011/0259603 | A1* | 10/2011 | Kent | E21B 23/06 166/380 |
| 2011/0259610 | A1 | 10/2011 | Shkurti et al. | |

* cited by examiner

OFF-SET TUBING STRING SEGMENTS FOR SELECTIVE LOCATION OF DOWNHOLE TOOLS

TECHNICAL FIELD

Systems and methods for isolating multiple wellbore intervals are provided which can be similar to ball and seat isolation systems. An isolation well tool can include an isolation device and an isolation mandrel, where the isolation mandrel is interconnected in a tubing string in a wellbore and selectively allows the isolation device to pass through the isolation mandrel as the isolation device is displaced along an internal flow passage of the tubing string. The length of the isolation device determines whether the isolation mandrel will permit the isolation device to pass or prevent the isolation device from passing through the isolation mandrel. According to an embodiment, the isolation well tool can be used in an oil or gas well operation.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
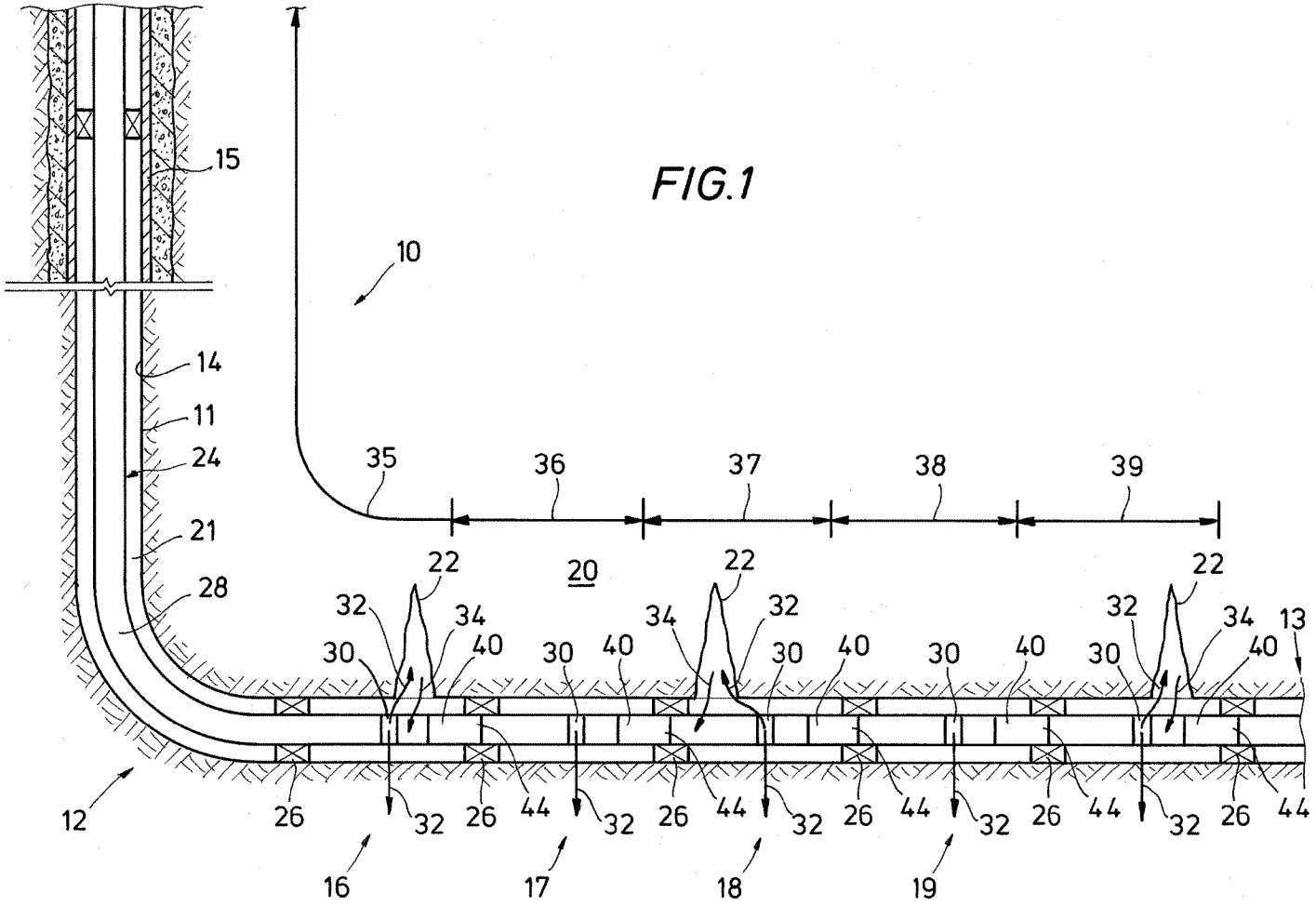
FIG. 1 is a schematic diagram of a well system containing multiple wellbore isolation tools that isolate multiple intervals in a wellbore of the well system.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more materials, layers, isolation tools, isolation devices, isolation mandrels, wellbore intervals, etc., as the case can be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

Oil and gas hydrocarbons are naturally occurring in some subterranean formations. In the oil and gas industry, a subterranean formation containing oil and/or gas is referred to as a reservoir. A reservoir can be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a well" means and includes into any portion of the well, including into the wellbore or into the near-wellbore region via the wellbore.

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device, in conjunction with an isolation mandrel, to create multiple wellbore intervals. At least one wellbore interval can correspond to a particular subterranean formation zone. The isolation device can be used for zonal isolation and functions to block fluid flow within a tubular, such as a tubing string, or within an annulus. The blockage of fluid flow prevents the fluid from flowing across the isolation device in any direction and isolates the zone of interest. In this manner, completion operations, such as well treatments, fracturing, injecting, production, etc., can be performed within the zone of interest.

Common isolation devices include, but are not limited to, a ball and a seat, a bridge plug, a frac plug, a packer, a plug, and wiper plug. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Zonal isolation can be accomplished via a ball and seat by dropping or flowing the ball from the wellhead onto the seat that is located within the wellbore. The ball engages with the seat, and the seal created by this engagement prevents fluid communication into other wellbore intervals downstream of the ball and seat. As used herein, the relative term "downstream" means at a location further away from a wellhead.

In order to treat more than one zone using a ball and seat, the wellbore can contain more than one ball seat. For example, a seat can be located within each wellbore interval. Generally, the inner diameter (I.D.) of the ball seats can be different for each zone. For example, the I.D. of the ball seats sequentially decreases at each zone, moving from the wellhead to the bottom of the well. In this manner, a smaller ball is first dropped into a first wellbore interval that is the farthest downstream; the corresponding zone is treated, tested, injected and/or produced; a slightly larger ball is then dropped into another wellbore interval that is located upstream of the first wellbore interval; that corresponding zone is then treated, tested, injected and/or produced; and the process continues in this fashion—moving upstream along the wellbore—until all the desired zones have been treated, tested, injected and/or produced. As used herein, the relative term "upstream" means at a location closer to the wellhead. Also, the current disclosure does not require that the multiple "seats" be a different diameter as typical ball and seat systems generally require.

The tubing string has a limited inner diameter. Moreover, the difference in the inner diameter of each seat must be sufficiently different to allow for the different sized balls to fall through the tubing string to its desired seat. Therefore, being able to create a multitude of wellbore intervals has been quite challenging. There is a need for improved systems that allow for a multitude of wellbore intervals to be created. It has been discovered that multiple wellbore intervals can be created without any regard to the inner diameter of the tubing string.

According to an embodiment, a system for selective isolation of multiple wellbore intervals comprises: an isolation mandrel interconnected in a tubing string, where the tubing string has a flow passage that extends through the isolation mandrel. The isolation mandrel can include, an entry bore (or channel), a transition chamber, and an exit bore (or channel), with the transition chamber positioned between the entry and exit bores (or channels), and the transition chamber being radially enlarged relative to the entry and exit bores (or channels). The isolation device having a predetermined length can be displaced through the tubing string to the isolation mandrel where it selectively permits and prevents fluid flow through the isolation mandrel.

According to another embodiment, a method of selectively performing a wellbore operation on multiple wellbore intervals comprises: interconnecting an isolation mandrel in a tubing string. The isolation mandrel can include: an entry bore (or channel), a transition chamber, and an exit bore (or channel), with the transition chamber located between the entry and exit bores (or channels), and the transition chamber being radially enlarged relative to the entry and exit bores (or channels). Displacing an isolation device through the tubing string to the isolation mandrel, the isolation device having a predetermined length, and selectively permitting and preventing displacement of the isolation device through the isolation mandrel in response to the length of the isolation device.

According to yet another embodiment, a wellbore isolation tool for selectively isolating multiple wellbore intervals comprises: an isolation mandrel that can include, an entry bore (or channel), a transition chamber, and an exit bore (or channel), with the transition chamber being positioned between the entry and exit bores (or channels), and where an inner diameter of the transition chamber is greater than a minimum inner diameter of the entry and exit bores (or channels). An isolation device that is displaced through the entry bore (or channel) and at least partially into the transition chamber, with the isolation device selectively permitting and preventing fluid flow through the isolation mandrel in response to a length of the isolation device.

Any discussion of the embodiments regarding the isolation device or the isolation mandrel, or any component related to the isolation device or the isolation mandrel is intended to apply to all of the apparatus, system, and method embodiments.

Turning to the Figures, FIG. 1 depicts a well system 10. The well system 10 can include at least one wellbore 11. The wellbore 11 can penetrate a subterranean formation 20. The subterranean formation 20 can be a portion of a reservoir or adjacent to a reservoir. The wellbore 11 can include a casing 15. A tubing string 24 (which can also be a casing string 15, or a stimulation tubing string, coiled tubing, etc.) can be installed in the wellbore 11. The well system 10 can include at least a first wellbore interval 35 and a second wellbore interval 36. The well system 10 can also include more than two wellbore intervals, for example, the well system 10 can further include a third wellbore interval 37, a fourth wellbore interval 38, a fifth wellbore interval 39, and so on. At least one wellbore interval can correspond to a zone of the subterranean formation 20.

The well system 10 can contain multiple packers 26, multiple flow control devices 30 and multiple wellbore isolation tools 40 located within multiple zones 16, 17, 18, 19 of the well system 10. The methods include selectively permitting and preventing fluid flow through the wellbore isolation tools 40, thereby selectively isolating wellbore intervals 35, 36, 37, 38, 39 for performing completion operations, such as well treatment, injecting, fracturing, well testing, and fluid production, on one or more wellbore intervals while isolating one or more downstream wellbore intervals 35, 36, 37, 38, 39 from the completion operations.

When fluid flow is prevented between one or more wellbore intervals 35, 36, 37, 38, 39, respective flow control devices 30 can be used in completion operations within one or more of the wellbore intervals 35, 36, 37, 38, 39 or formation zones upstream of the blocked wellbore isolation tool 40. For example, an injection fluid can be flowed into any of the zones 16, 17, 18, 19, and/or fracturing fluid can be flowed into the formation 20 to initiate fractures 22, as shown by arrows 32. Additionally, fluid and/or gas can be flowed, as shown by arrows 34, into the tubing string 24 from the zones 16, 17, 18, 19 and/or fractures 22 during production operations.

The wellbore 11 can have a generally vertical uncased section 14 extending downwardly from a casing 15, as well as a generally horizontal uncased section extending through the subterranean formation 20. The wellbore 11 can alternatively include only a generally vertical wellbore section or can alternatively include only a generally horizontal wellbore section. The wellbore 11 can include a heel 12 and a toe 13.

The wellbore isolation tools 40 can be used to selectively permit and prevent fluid flow between various wellbore intervals. Each wellbore isolation tool 40 includes an isolation mandrel 44 and an isolation device 42. The isolation mandrels 44 can be interconnected in the tubing string 24 as seen in FIG. 1. However, the mandrels 44 can alternatively, or in addition to, be interconnected in a tubing string 24 that is a casing string 15 as seen in FIG. 2B.

In general, a particular isolation tool 40 interconnected in the tubing string 24 has an isolation mandrel 44 with a longitudinal length that is longer than isolation mandrel(s) 44 that are downstream from the particular isolation tool 40. Also, the particular isolation tool 40 can have an isolation mandrel 44 with a longitudinal length that is shorter than isolation mandrel(s) 44 that are upstream from the particular isolation tool 40. The end isolation mandrels 44 (i.e., the ones located the farthest downhole or nearest to the wellhead) cannot have one of the upstream or downstream isolation mandrels.

In operation, the isolation devices 42 can be separately (or simultaneously) displaced through the tubing string 24 into respective isolation mandrels 44. The isolation devices 42 can be displaced through the tubing string by gravity, tethered to an end of a wire line or coiled tubing, pumped through a flow passage of the tubing string via fluid pressure, and/or any other suitable method for displacing the devices 42 through the tubing string 24 to the respective isolation mandrels 44.

The isolation devices 42 have different predetermined lengths, and when they are displaced through the flow passage, their lengths determine which of the isolation mandrels 44 that the individual isolation devices 42 will land in and engage a no-go feature, which causes the isolation device 42 to block (or prevent) flow through the respective isolation mandrel 44 in which the device 42 has landed. An isolation device 42 can be landed in the isolation mandrel 44 that is closest to the toe 13 of the wellbore (i.e., farthest downhole). This isolates all wellbore intervals downstream of this isolation mandrel 44 from all other wellbore intervals 35, 36, 37, 38, 39 that are upstream of the farthest downhole isolation mandrel 44. Therefore, wellbore completion operations can be performed on any of these wellbore intervals 35, 36, 37, 38, 39 without impacting the downstream wellbore intervals.

Please note that FIG. 1 shows five wellbore intervals 35, 36, 37, 38, 39, five isolation tools 40, and five flow control devices. However, it should be clearly understood that there can be any number of these items in the well system 10. For example, there can be multiple wellbores 11, lateral wellbores, one or more wellbore intervals 35, 36, 37, 38, 39, none, one or more flow control devices 30, none, one or more packers 26, etc. There can be multiple wellbore intervals 35, 36, 37, 38, 39 associated with one isolation tool 40, or multiple isolation tools 40 associated with one or more wellbore intervals 35, 36, 37, 38, 39. Some or all of the packers 26 can be replaced by cement-filling the annulus 21. The tubing string can include any other well tools suitable for carrying out wellbore completion operations, such as sensors, perforating guns, wellbore test equipment, etc. The isolation tools 40 can also be used with other ball and seat isolation systems for isolating various wellbore intervals 35, 36, 37, 38, 39. Therefore, it is clearly understood that many variations of the well system 10 shown in FIG. 1 are possible in keeping with the principles of this disclosure.

Figure 2A:
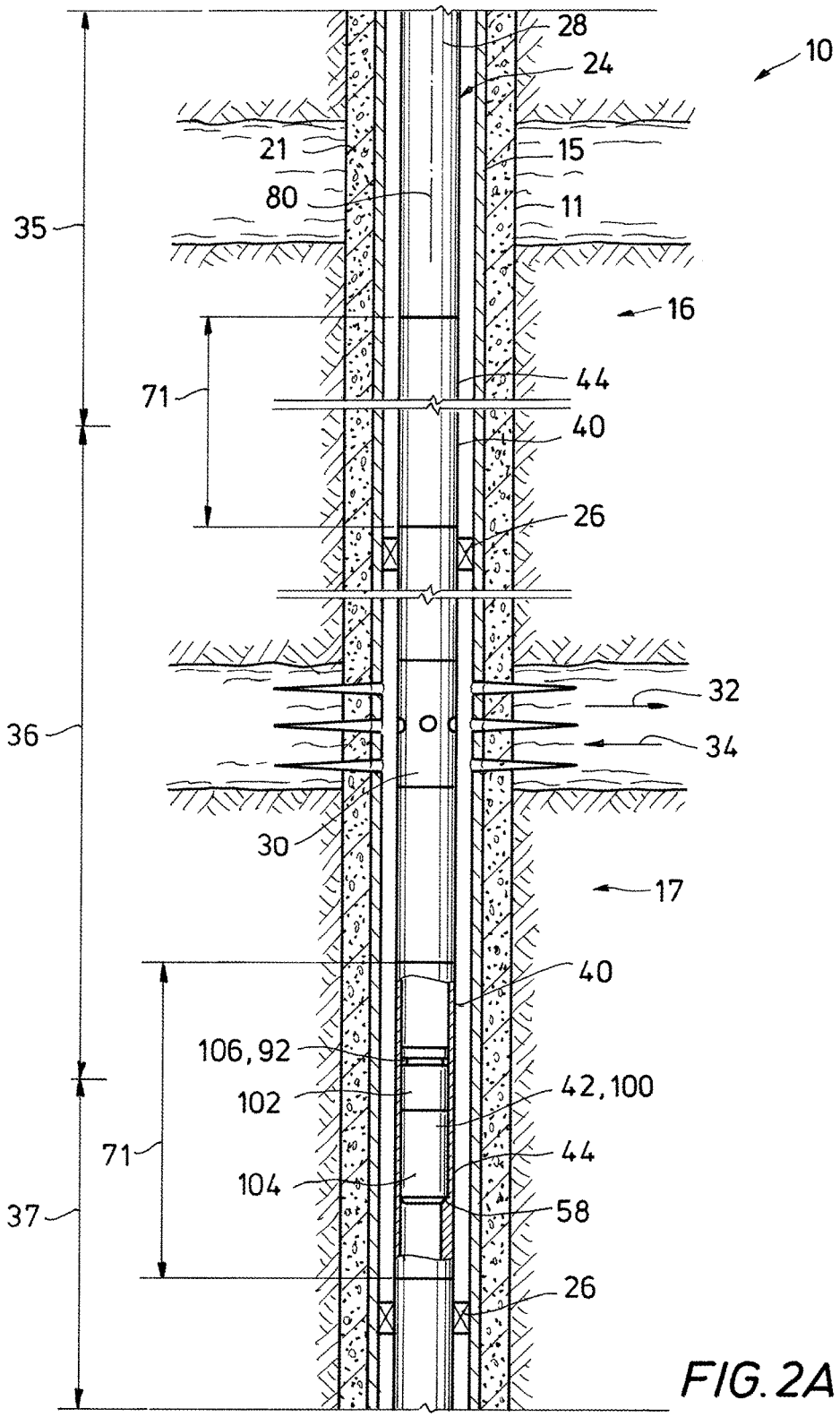
FIGS. 2A-2B are schematic diagrams of a well system containing multiple wellbore isolation tools for isolating multiple intervals in a wellbore of the well system.
Figure 2B:
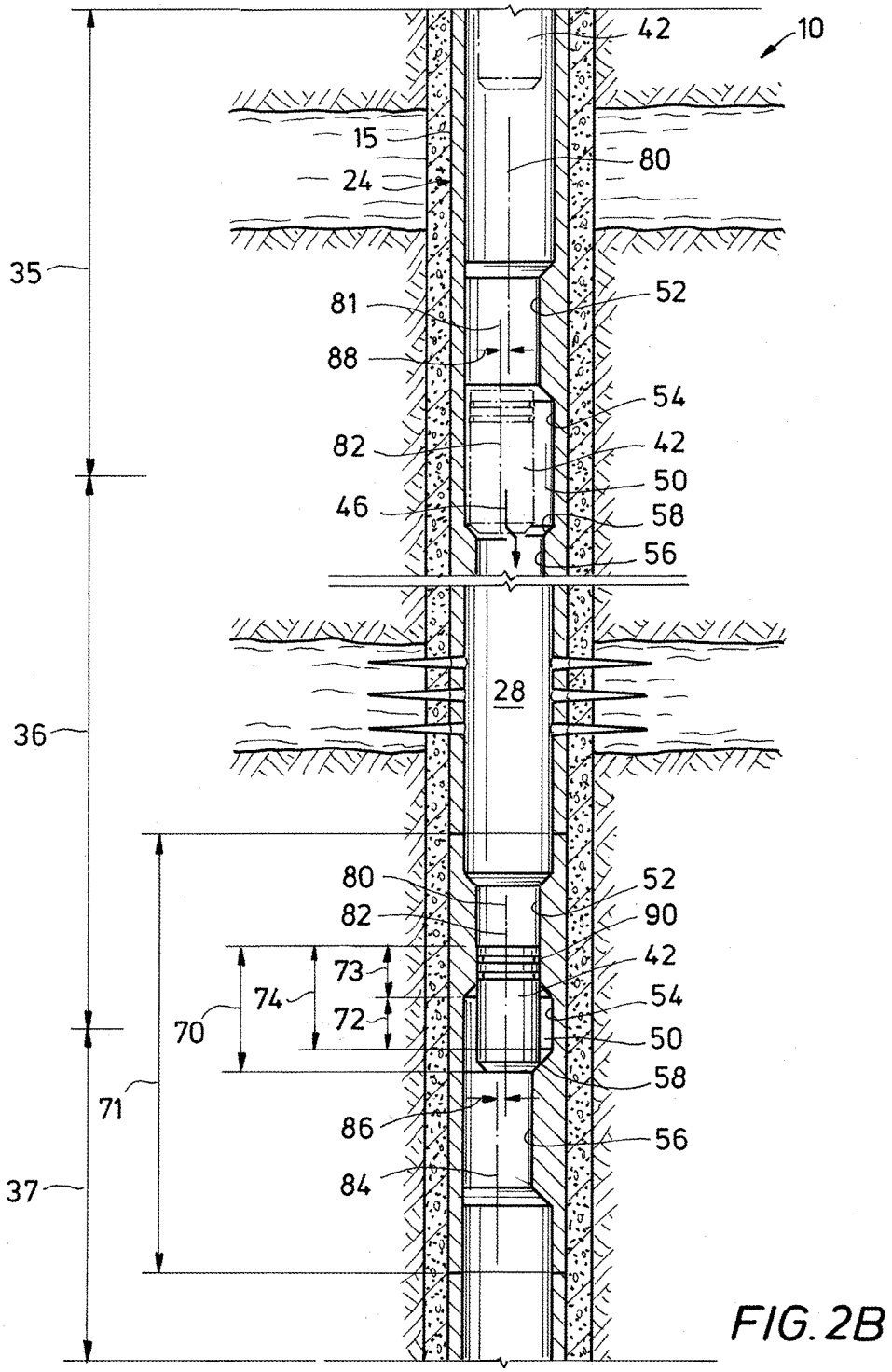

FIGS. 2A-2B are partial cross-sectional views of a longitudinal portion of a vertical wellbore 11. FIGS. 2A-2B illustrate that different numbers of zones and wellbore intervals can be included in keeping with the principles of this disclosure. FIGS. 2A-2B include two zones 16, 17, with one zone 17 including perforations that extend from the flow passage 28 of the tubing string 24 into a production layer of zone 17. Fluids can flow between the flow passage 28 and the zone 17 during completion operations, such as well treatment, injection, fracturing, well testing, and production of a reservoir fluid, as shown by arrows 32, 34. The flow control device 30 can be used to control the outflow and/or inflow rates of fluids between the flow passage 28 and the zone 17. Partial wellbore intervals 35 and 37 are shown, as well as the wellbore interval 36. Generally, the wellbore intervals correspond to an interval of the wellbore between adjacent isolation tools 40, but it is not necessary that one wellbore interval be associated with adjacent isolation tools 40. For example, multiple adjacent isolation tools 40 can be associated with a single wellbore interval, or multiple wellbore intervals can be associated with a single pair of adjacent isolation tools 40.

FIGS. 2A-2B depict two isolation tools 40, and for purposes of discussion only, the upstream isolation tool 40 can be referred to as a first isolation tool 40 with a first isolation mandrel 44 and an associated first isolation device 42. The downstream isolation tool 40 can be referred to as the second isolation tool 40 with a second isolation mandrel 44 and an associated second isolation device 42.

The individual isolation mandrels 44 are "associated" with a particular isolation device 42 because they are pre-selected to be matched pairs with a device 42 and mandrel 44 per pair. When the "associated" isolation device is displaced through the tubing string 24 to the "associated" (or paired) isolation mandrel 44, the "associated" isolation device 42 will land in the "associated" isolation mandrel 44 and prevent flow through the "associated" isolation mandrel 44. The isolation mandrels 44 are interconnected in the tubing string 24 prior to or during installation of the tubing string 24 in the wellbore 11. Then their associated or paired isolation devices 42 are displaced through the tubing string 24 to their associated or paired isolation mandrel 44.

Once the tubing string in positioned in the well (e.g., cemented in the wellbore, packers set, etc.), then the isolation devices 42 are individually introduced into the tubing string 24 at the surface and/or above a wellhead. There can be a significant time delay between introducing the first isolation device 42 in the tubing string 24, or the time delay can be quiet small, such that the isolation devices are traveling (i.e., displacing) through the tubing string simultaneously. However, it is preferred that the time delay between introductions of the isolation devices 42 into the tubing string 24 is long enough that the wellbore operations for a particular wellbore interval are complete before introducing the next isolation device 42.

The first isolation mandrel 44 with a longitudinal length 71 is shown in FIG. 2A as being interconnected in the tubing string 24. This length 71 is selected and interconnected in the tubing string 24 prior to installation of the tubing string 24 into the wellbore 11. The length 71 of the first isolation mandrel 44 generally determines which of the multiple isolation devices 42 is associated (or paired) with the first isolation tool 40, such that the associated isolation device 42 will land in the first isolation mandrel 44 and block flow through the first isolation tool 40.

The second isolation tool 40 is shown as a partial cross-sectional view with portions of the second isolation mandrel 44 removed for clarity. The second isolation mandrel 44 is shown as the being interconnected in the tubing string 24 farther downstream (e.g., longitudinally spaced apart) from the first isolation mandrel 44. The second isolation mandrel 44 is also indicated as having a length 71. However, the lengths 71 of the first and second isolation mandrels 44 are preferably different. The farthest downhole mandrel 44 (e.g., second mandrel 44) is preferably shorter than the upstream mandrel 44 (e.g., first mandrel 44).

However, it is not a requirement that the farthest downhole be the shortest of the first and second isolation mandrels 44. The isolation devices 42 can be retrieved from the wellbore, dissolved in the wellbore, or otherwise degraded in the wellbore to remove the isolation device from the isolation mandrel 44 in which it landed. For example, the isolation device can be made of a frangible material that will breakup at a predetermined pressure differential. Once the device 42 is broken, the well fluids can then dissolve and/or degrade the pieces. The isolation devices 42 can also be dissolved or otherwise degraded to remove them from the isolation mandrels 44. Therefore, the isolation devices can be introduced into the tubing string 24 in any order in keeping with the principles of this disclosure.

The length 71 of the second isolation mandrel 44 is also selected prior to interconnection of the second isolation mandrel 44 in the tubing string and installation of the tubing string 24 in the wellbore. The length 71 generally determines which of the multiple isolation devices 42 is associated (or paired) with the second isolation tool 40, and thereby indicates which of the multiple isolation devices 42 will displace through the first isolation mandrel, and land in the second isolation mandrel 44, thereby blocking flow through the second isolation tool 40. When the isolation device 42 is a lock mandrel 100, as seen in FIG. 2A, the lock mandrel 100 can be activated to extend an engagement device 106 (e.g., collet, dog, lug, etc.) into engagement with a landing nipple 92 in the isolation mandrel 44. The engagement of the device 106 with the landing nipple 92 will help prevent displacement of the lock mandrel 100 in either the upstream or downstream directions, if environmental conditions cause an upward force on the locking mandrel 100.

The cross-sectional view of the second isolation tool 40 reveals the second isolation device 42 as being a lock mandrel 100. The lock mandrel 100 is shown engaging a no-go surface 58 of the isolation mandrel 44, thereby landing (or preventing further displacement of) the lock mandrel 100 in the second isolation mandrel 44. Flow between intervals 36 and 37 is prevented due to the landing of the lock mandrel 100 (or isolation device 42) in the second isolation mandrel 44. Please note that the lock mandrel 100 is shown as including two modules 102, 104, with the standard length module 102 being substantially the same length for various lock mandrels 100 with various longitudinal lengths. The variable length module 104 allows convenient configuration of the lock mandrel 100 (or isolation device 42) into any number of length configurations by connecting various modules 104 of various lengths to standard length modules 102. This can allow simpler manufacturing of the more expensive standard length module 102 and can also allow reuse of the standard length modules 102. The module 102 can include various downhole tools, such as sensors, electronics, controllers, telemetry devices, power sources, etc. Of course, the variable length module 104 can also include sensors, electronics, etc., but it is preferred that these are contained within the module 102.

Please note that the configuration of the well system 10 shown in FIGS. 2A and 2B in no way limits the principles of this disclosure to any features and/or lack of features shown in these figures. For example, more or fewer isolation tools 40 can be used along with more or fewer wellbore intervals than the intervals 35, 36, 37 shown in these figures.

It should also be clear that the terms "first" and "second" in these discussions in no way implies a connection to items in the appended claims that can be phrased similarly.

FIG. 2B depicts various stages of an isolation device 42 being displaced through the tubing string 24 to finally land in an isolation mandrel 44, thereby preventing fluid flow between wellbore intervals 37 and 36. For purposes of discussion only, the upstream isolation tool 40 can be referred to as a first isolation tool 40 with a first isolation mandrel 44 and an associated first isolation device 42. The downstream isolation tool 40 can be referred to as a second isolation tool 40 with a second isolation mandrel 44 and an associated second isolation device 42.

In this case, the second isolation device 42, which is associated with the second isolation mandrel 44, is being displaced through the tubing string 24 (which is also the casing string 15). Three separate points in time are indicated by the separate locations of the second isolation device 42 along the tubing string 24. The first two locations are indicated by dashed lines outlining the second isolation device 42. The first location of the isolation device 42 is shown as the device enters a portion of the wellbore included in FIG. 2B. The second location of the second isolation device 42 is shown in a transition chamber of the first isolation mandrel 44. The third location shows the second isolation device 42 landed in the second isolation mandrel 44. Please note that this isolation device can be any one or more of a lock mandrel, a plug, a dart, a cylindrical tube, a tubular packer, a bridge plug, a frac plug, etc. in keeping with the principles of this disclosure. The isolation device 42 shown in FIG. 2B is merely a graphical representation of these things the isolation device 42 can be.

The second isolation device 42 travels through the tubing string 24, the tubing string having a longitudinal axis 80. Each of the first and second isolation mandrels 44 includes an entry bore 52, and exit bore 56, and a transition chamber 50 having a chamber bore 54, where the transition chamber 50 is positioned between the entry and exit bores 52, 56, as shown in FIG. 2B. The length 71 of each isolation mandrel 44 is generally changed by varying the lengths of the entry, exit and chamber bores 52, 56, 54, respectively. However, varying the length 72 of the chamber bore 54 is a significant factor in determining which of the multiple isolation devices 42 is associated with a particular isolation mandrel 44.

The inner diameter of portions of the tubing string 24 that are outside of the isolation mandrels 44 is preferably larger than the entry bores 52 and the exit bores 56 of the isolation mandrels 44. This larger diameter allows the isolation devices 42 to more freely travel through the tubing string prior to and after traveling through an isolation mandrels 44. As seen in FIG. 2B, the second isolation device 42 displaces through the tubing string 24, through the entry bore 52, and into the transition chamber 50. A diameter of the second isolation device 42 is slightly smaller than a diameter of the entry and exit bores 52, 56 of the first isolation mandrel 44, so that an annular seal 90 can provide a suitable interference fit with the entry and exit bores 52, 56 to sealingly engage the bores 52, 56.

A central longitudinal axis 81 of the entry bore 52 can be radially offset from the central longitudinal axis 80 of the tubing string by an offset 88. When the second isolation device 42 is displaced into the entry bore 52 of the first isolation mandrel 44, the second isolation device 42 can be radially shifted to align its longitudinal axis 82 with the longitudinal axis 81 of the entry bore 52. Please note, however, that it is not necessary that the entry bore be eccentrically arranged (i.e., a longitudinal axis 81 of the entry bore 52 is radially offset by offset 88 from the tubing string axis 80). Instead, the longitudinal axis 81 of the entry bore 52 can be coaxially aligned (i.e., the longitudinal axis 81 is in line with the longitudinal axis 80 of the tubing string 24).

The second isolation device 42 has a longitudinal length 70, which can include multiple modules, such as the standard length module 102 and the variable length module 104, such as for the lock mandrel 100, or can include a single variable module such as a dart, plug, etc. As the second isolation device 42 displaces into the transition chamber 50 it is allowed to completely exit the entry bore 52 before entering the exit bore 56, if the length 70 is less than a no-go length of the isolation mandrel 44. Since the second isolation device 42 is fully contained within the transition chamber 50 of the first isolation mandrel 44, it is allowed to move or displace radially (as shown by arrow 46) to align with the longitudinal axis 84 of the exit bore 56 (axis 84 not shown in the first isolation mandrel, see second isolation mandrel for reference).

This realignment within the transition chamber 50 of the first isolation mandrel 44 allows the second isolation device 42 to enter the exit bore 56 and continue moving through the tubular string to the second isolation mandrel 44. The first isolation mandrel 44 has a no-go surface 58 that is used to no-go the second isolation device 42 (i.e., prevent further longitudinal displacement of the second isolation device 42 in a downhole direction) if the length 70 of the second isolation device 42 is greater than or equal to the no-go length 74 of the isolation mandrel 44 (as is the case with the second isolation mandrel 44), the second isolation device 42 will engage the no-go surface 58 preventing the second isolation device 42 from fully exiting the isolation mandrel 44 and will not be allowed to enter the exit bore 56. In this manner, the length of a particular isolation device can be used to either allow the passage of the isolation device through the isolation mandrel or no-go within the isolation mandrel based on the length of the transition chamber.

However, the no-go length 74 of the first isolation mandrel 44 is longer than the length 70 of the second isolation device 42, so the second isolation device 42 is allowed to pass through the first isolation mandrel 44 without landing in the mandrel. It can be clearly understood that the second isolation device 42 can indeed temporarily engage the no-go surface 58, but it will not remain engaged with the surface 58 since the second isolation device 42 is allowed to radially displace in the transition chamber 50 to align with the exit bore 56 and thereby bypass the no-go surface 58 of the first isolation mandrel 44. The no-go surface 58 is shown a being a linear inclined shape. However, the no-go surface 58 can be any surface that will urge the isolation device 42 into alignment with the exit bore axis 84.

Each of the multiple isolation mandrels includes the no-go length 74, which can include a longitudinal length 72 of the chamber bore 54 and a longitudinal length 73 of a portion of an end of the entry bore 52 that is near the transition chamber 50. This portion of the entry bore 52 can be any length including "zero" depending on the design of bore transitions between the entry, exit and chamber bores 52, 56, 54, as well as a design of the ends of the isolation devices 42.

The second isolation device 42 then continues its journey through the tubing string 24 and into the entry bore 52 of the second isolation mandrel 44. As seen in FIG. 2B, the entry bore 52 of the second isolation mandrel 44 is coaxially aligned with the axis 80 of the tubing string 24 (i.e., the offset 88 is "zero"). When the second isolation device 42 enters the transition chamber 50 and extends through the chamber 50, the second isolation device 42 will engage with the no-go surface 58 before the second isolation device fully exits the entry bore 52. This occurs as a result of the length 70 of the second isolation device 42 being greater than the no-go length 74 of the second isolation mandrel 44.

Since a portion of the second isolation device 42 remains in the entry bore 52, the second isolation device 42 is prevented from radially displacing in the transition chamber 50 to align with the exit bore 56, the exit bore 56 being radially offset from the entry bore axis 82 (and in this case tubing string axis 80) by offset 86. It can be said that the second isolation device 42 is "landed" in the second isolation mandrel 44, where "landed" (or no-go) indicates that the second isolation device 42 is prevented from further longitudinal displacement in a downstream direction.

The portion of the second isolation device 42 that remains in the entry bore 52 can include a seal 90 (e.g., an annular seal or seals, such as O-rings, chevron seals, cup seals, etc.) that sealing engages the entry bore 52 and prevents fluid flow through the second isolation mandrel 44. With the second isolation device 42 landed in second isolation mandrel 44, completion operations can be performed on wellbore intervals 35 and/or 36, which are upstream from the second isolation mandrel 44, without affecting the wellbore interval 37, which is downstream from the second isolation mandrel 44.

Figure 3A:
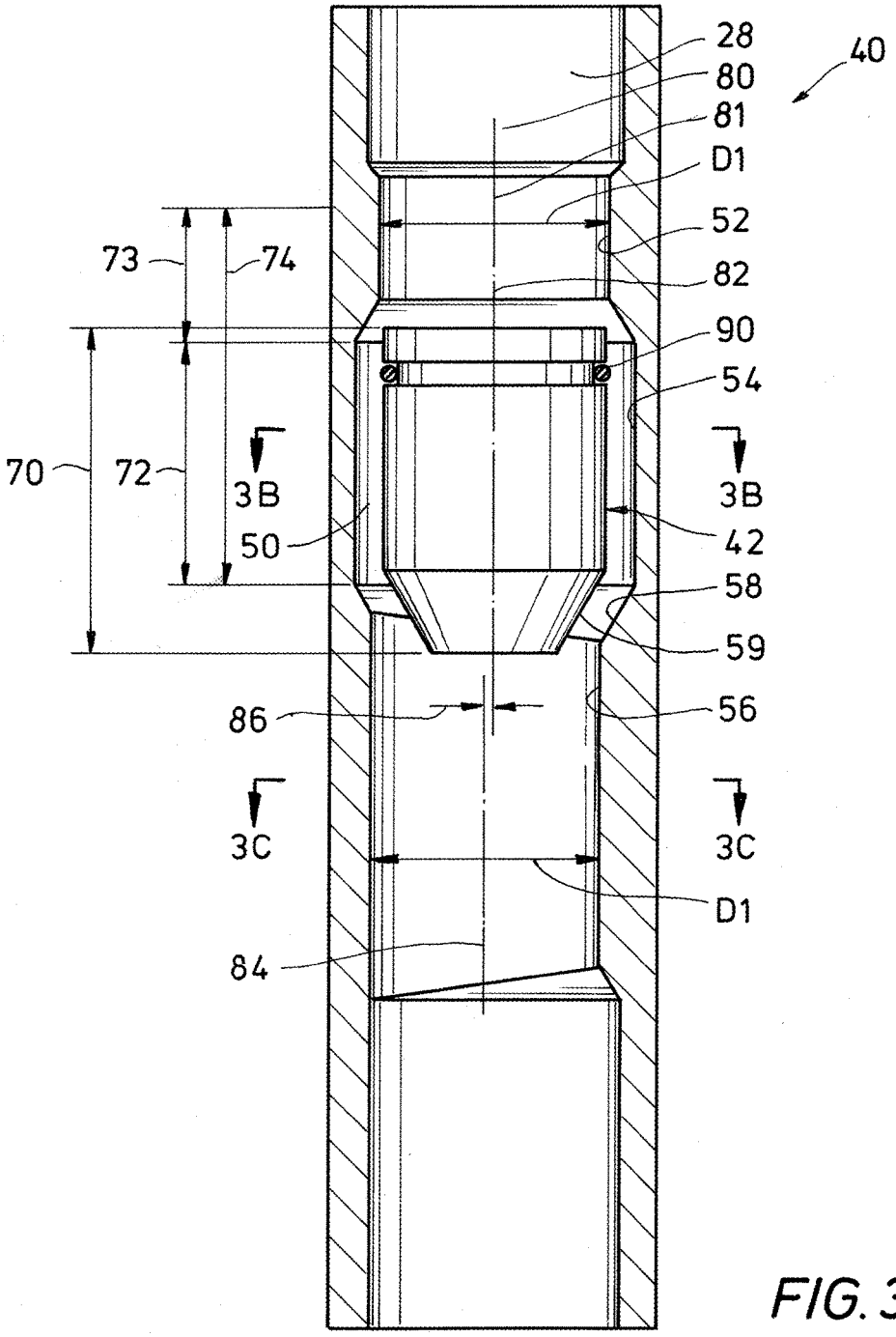
FIG. 3A is a schematic diagram of a wellbore isolation tool which can be utilized by any of the well systems shown in FIGS. 1, 2A, and 2B to selectively isolate multiple wellbore intervals.

FIG. 3A depicts an isolation mandrel 44 with the axis 84 of the exit bore 56 radially offset from the axis 82 of the entry bore 52 by offset 86. A short isolation device 42 (i.e., length 70 is less than the no-go length 74) has fully exited the entry bore 52 prior to engaging the no-go surface 58 of the isolation mandrel 44 with the surface 59 on the isolation device 42. Therefore, the isolation device 42 is allowed to radially shift in the transition chamber 50 to align with the radially offset exit bore 56 and then exit the transition chamber 50 through the exit bore 56 to continue on to the next isolation mandrel 44 in the tubing string (see FIG. 4).

As seen in FIG. 3A, the entry and exit bores 52, 56 have the same diameter D1. Diameter D1 is a minimum inner diameter of the isolation mandrels 44. This allows all isolation devices 42 to be substantially the same diameter, which allows multiple isolation tools 40 to be utilized in the tubing string without reducing the diameter of the flow passage 28 as successive isolation tools 40 are added to the tubing string 24. The inner diameter of the tubing string 24 can also be at the minimum diameter D1, but it is preferred that the diameter of the tubing string 24 be greater than D1 to minimize damage to the seal 90. The outer diameter D3 of the isolation device 42 is preferably slightly smaller than the minimum diameter D1 of the isolation mandrel 44 so that the isolation device 42 can easily travel through the entry and exit bores 52, 56 while sealingly engaging the entry and exit bores 52, 56 as the device 42 passes through them.

Figure 3B:
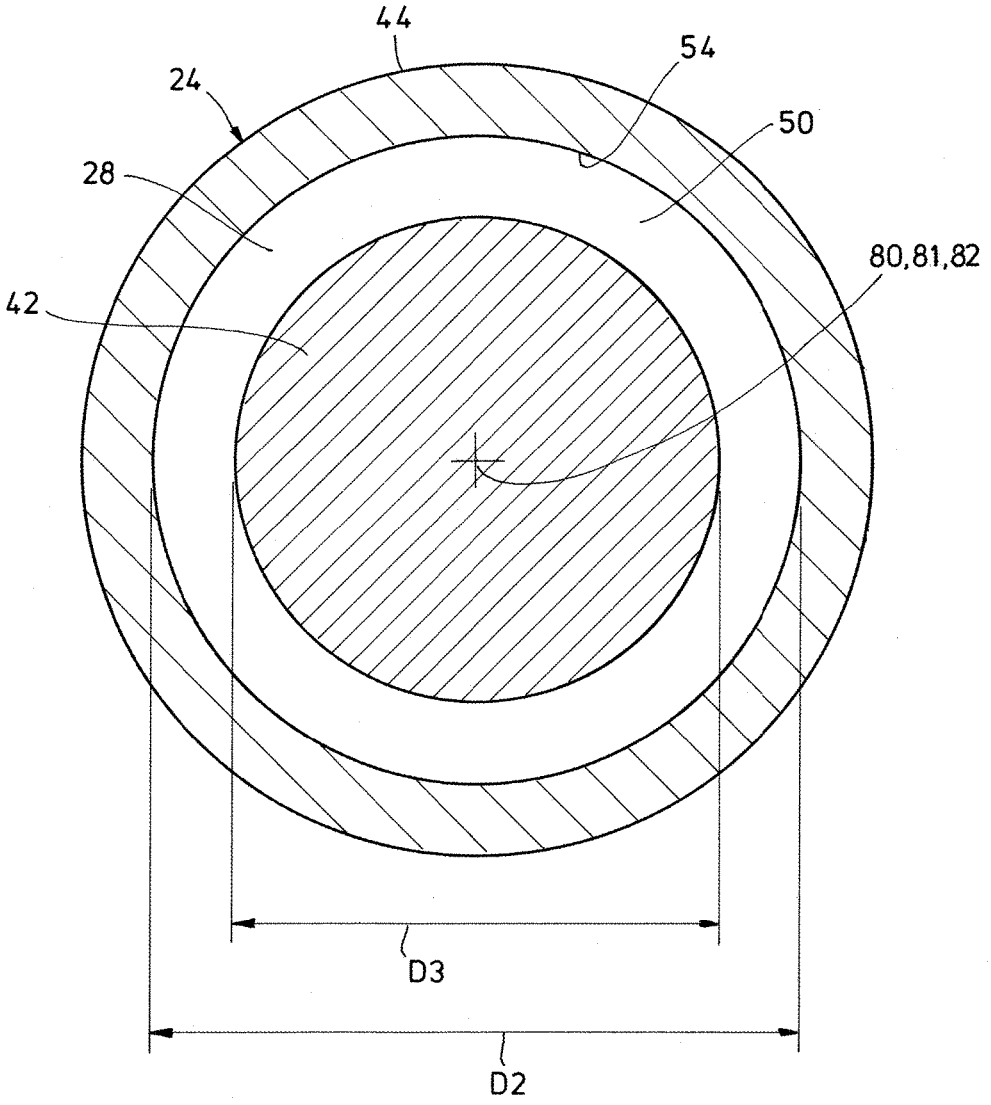
FIGS. 3B-3C are various cross-sectional views of the wellbore isolation tool of FIG. 3A.
Figure 3C:
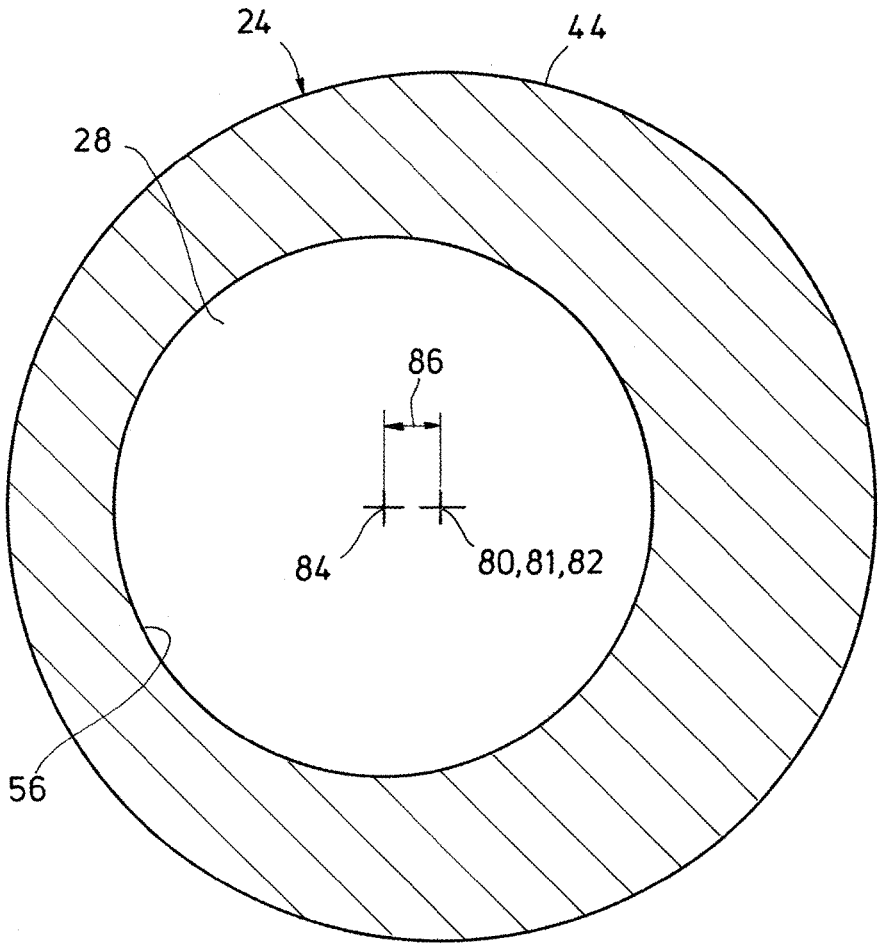

FIGS. 3B and 3C depict cross-sectional views of the isolation tool 40 in FIG. 3A. The diameter D2 of the transition chamber 50 is radially enlarged relative to the minimum inner diameter D1. FIG. 3B clearly indicates the enlarged diameter D2 of the transition chamber bore 54 compared to the diameter D3, which is only slightly smaller than the minimum inner diameter D1 of the isolation mandrel 44 that is interconnected in the tubing string 24. This larger diameter D2 of the transition chamber 50 allows more volume for the isolation device 42 to shift radially in the transition chamber 50 to align with the exit bore when the isolation device 42 does not remain engaged with the no-go surface 58. FIG. 3B depicts the isolation device 42 in the flow passage 28 inside the chamber 50, which has the chamber bore 54. The longitudinal axes 80, 81, 82 are shown aligned, which indicates that the isolation device 42 is coaxially aligned with the tubing string 24 and entry bore 52.

FIG. 3C depicts a cross-sectional view of the isolation mandrel 44 further downstream than FIG. 3B. The longitudinal axis 84 of the exit bore 56 is radially offset by offset 86 from the longitudinal axes 80, 81, 82 of the tubing string 24, the entry bore 52, and the isolation device 42, respectively.

Figure 4:
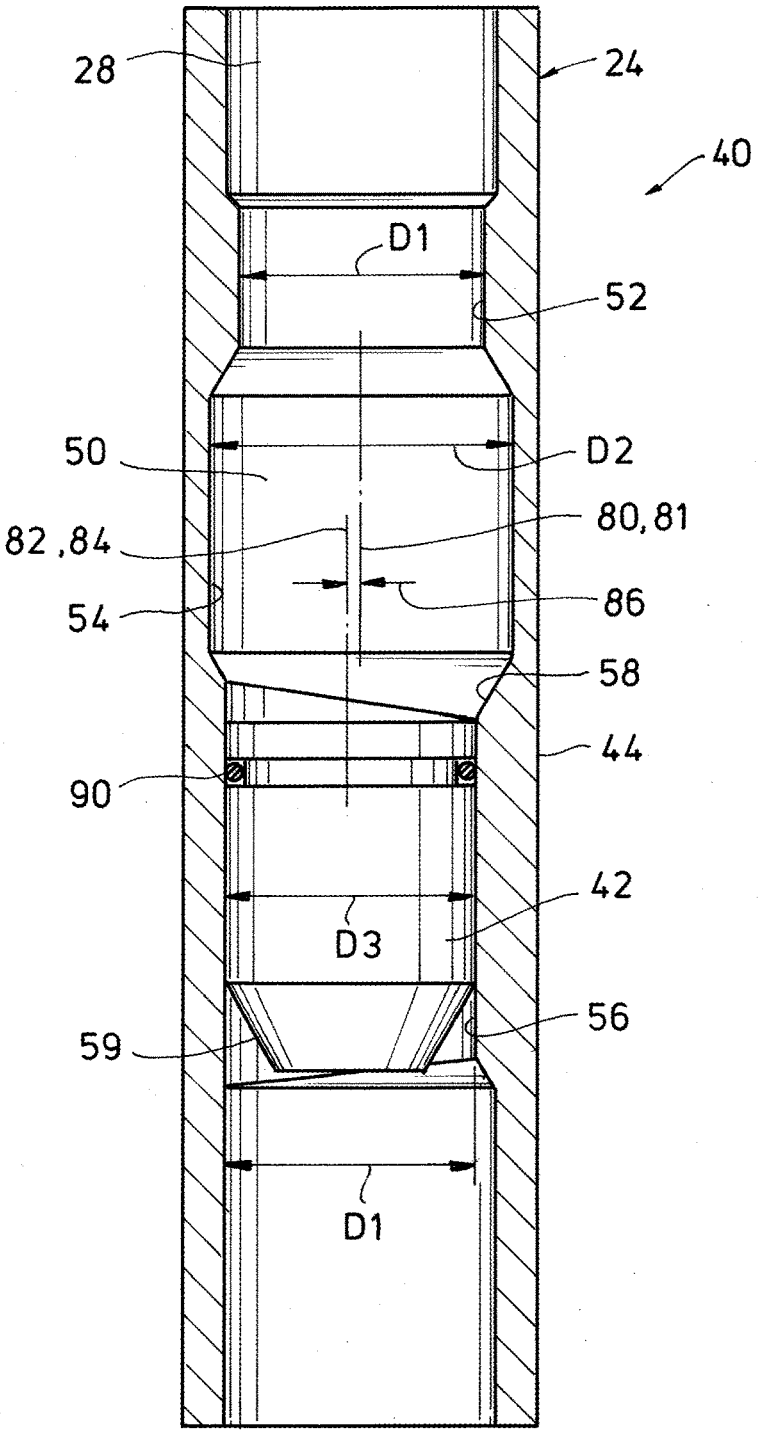
FIG. 4 is another schematic diagram of the wellbore isolation tool of FIG. 3A.

FIG. 4 depicts the isolation device 42 as it has traveled through the entry bore 52 and the transition chamber 50, and has entered the exit bore 56 to continue its journey further downstream in the tubing string 24. FIG. 4 again illustrates the relationships between the diameters D1, D2 and D3. FIG. 4 also indicates the no-go surface 58 in the isolation mandrel 44 and the surface 59 on the isolation device 42. As the isolation device 42 travels through the exit bore 56, the seal 90 sealing engages the exit bore 56.

Figure 5:
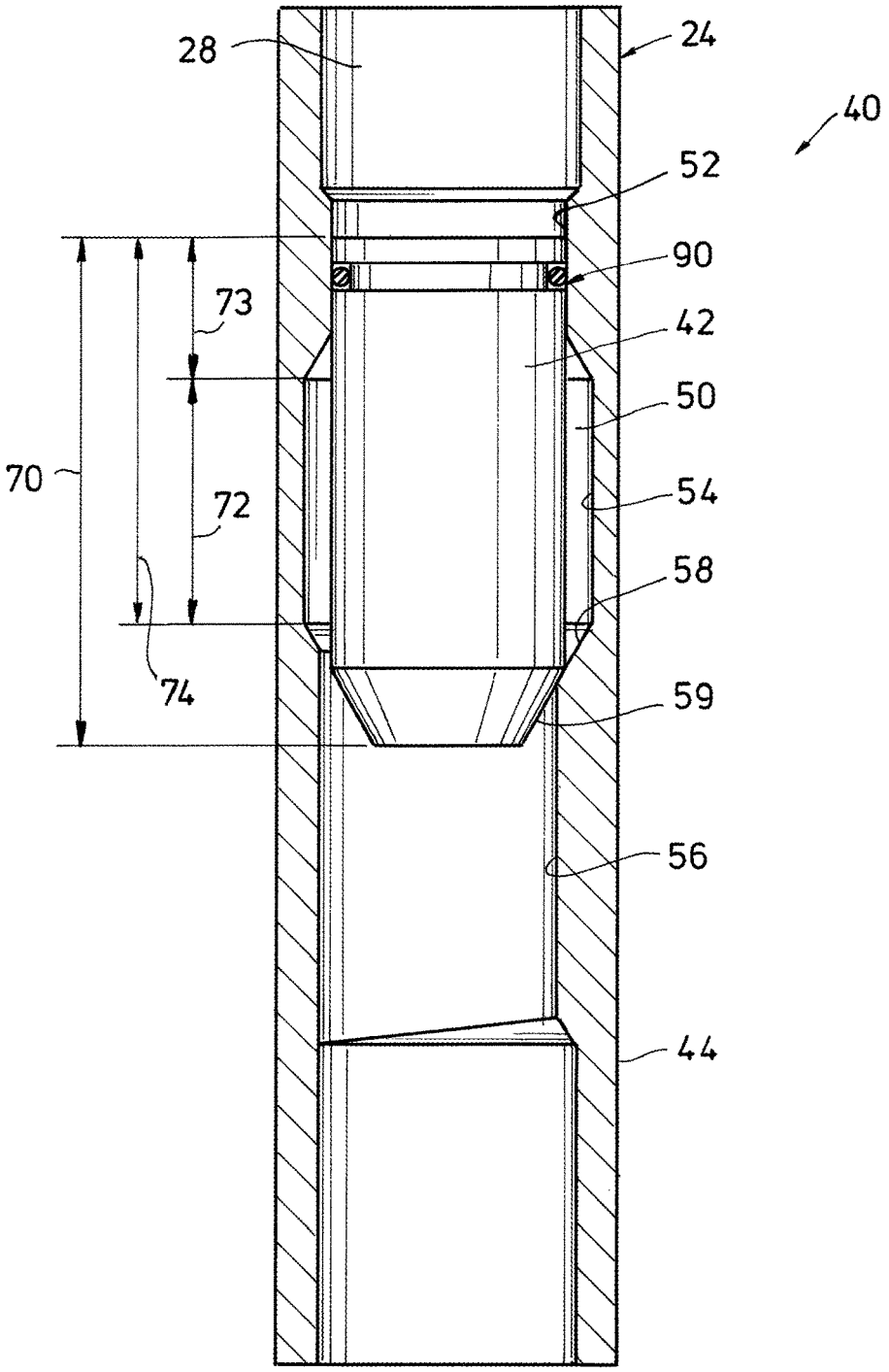
FIG. 5 is yet another schematic diagram of the wellbore isolation tool of FIG. 3A.

FIG. 5 depicts the isolation mandrel 44 of FIGS. 3A and 4 with the axis 84 of the exit bore 56 that is radially offset from the axis 82 of the entry bore 52 by offset 86. A long isolation device 42 (i.e., length 70 is equal to or greater than the no-go length 74) has engaged the no-go surface 58 of the isolation mandrel 44 with the surface 59 on the isolation device 42. Therefore, the isolation device 42 is landed (or a no-go) in the isolation mandrel 44. The engagement between the no-go surface 58 and the surface 59, prevents further displacement in the downhole direction, prevents the long isolation device 42 from fully exiting the entry bore 52, and prevents the isolation device 42 from being able to shift radially in the transition chamber and realigning with the exit bore 56. Therefore, the seal 90 remains engaged with the entry bore 52 and fluid flow through the isolation mandrel 44 is prevented.

Figure 6:
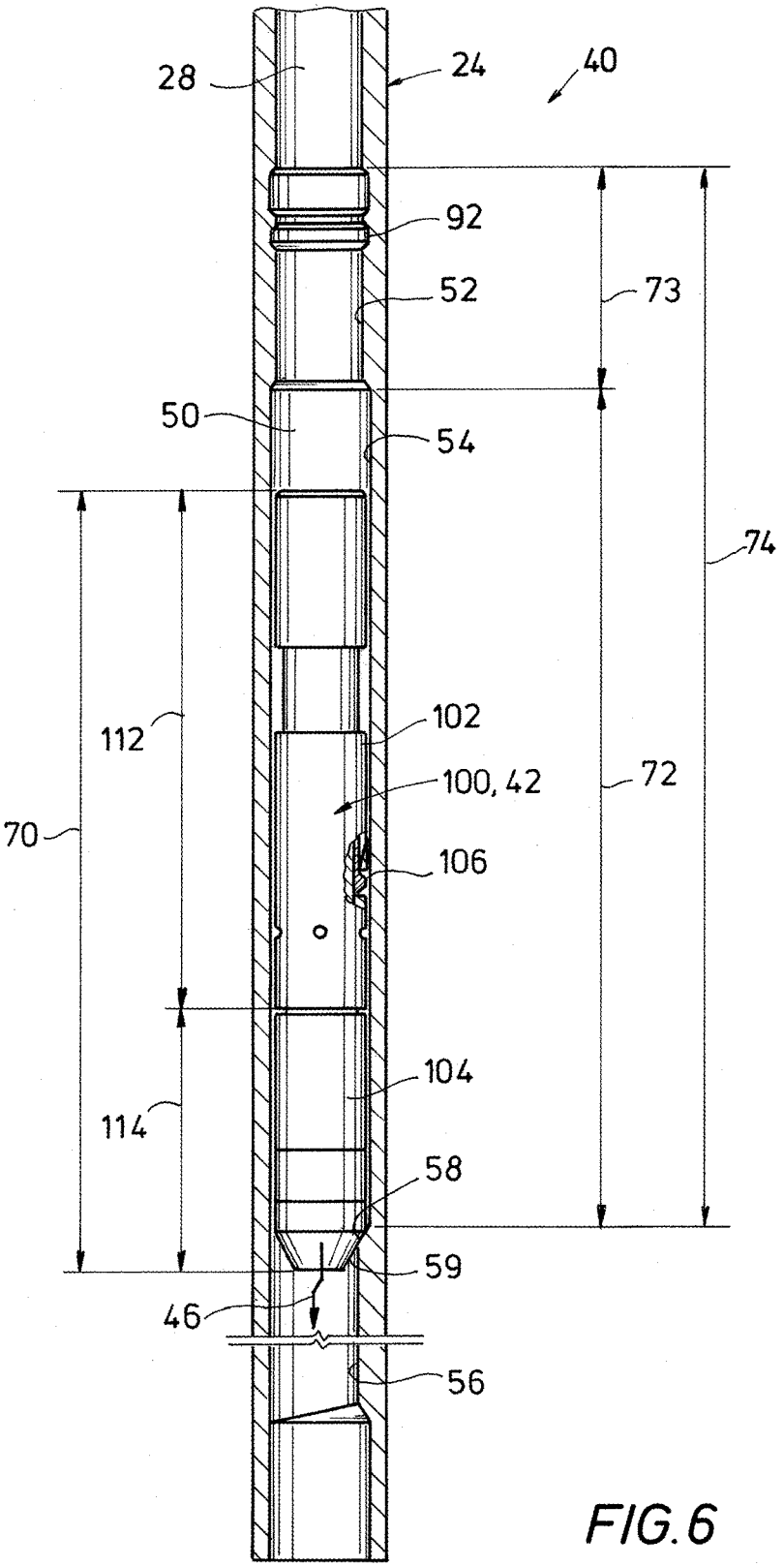
FIGS. 6-8 are schematic diagrams of a lock mandrel embodiment of a wellbore isolation tool.
Figure 7:
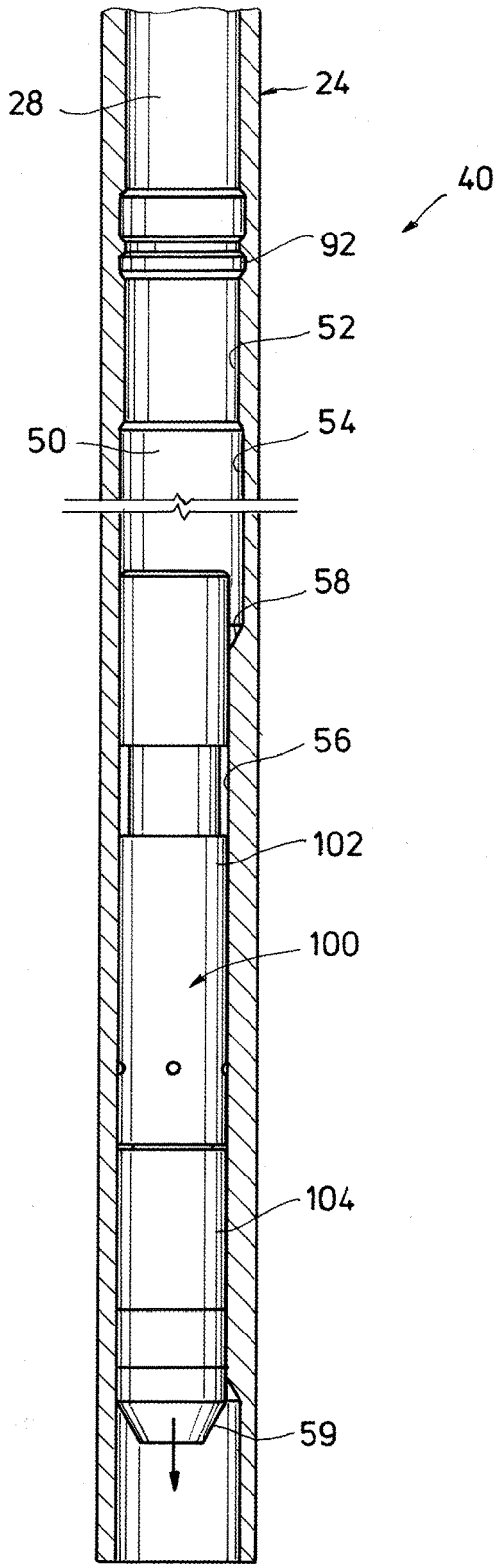
Figure 8:
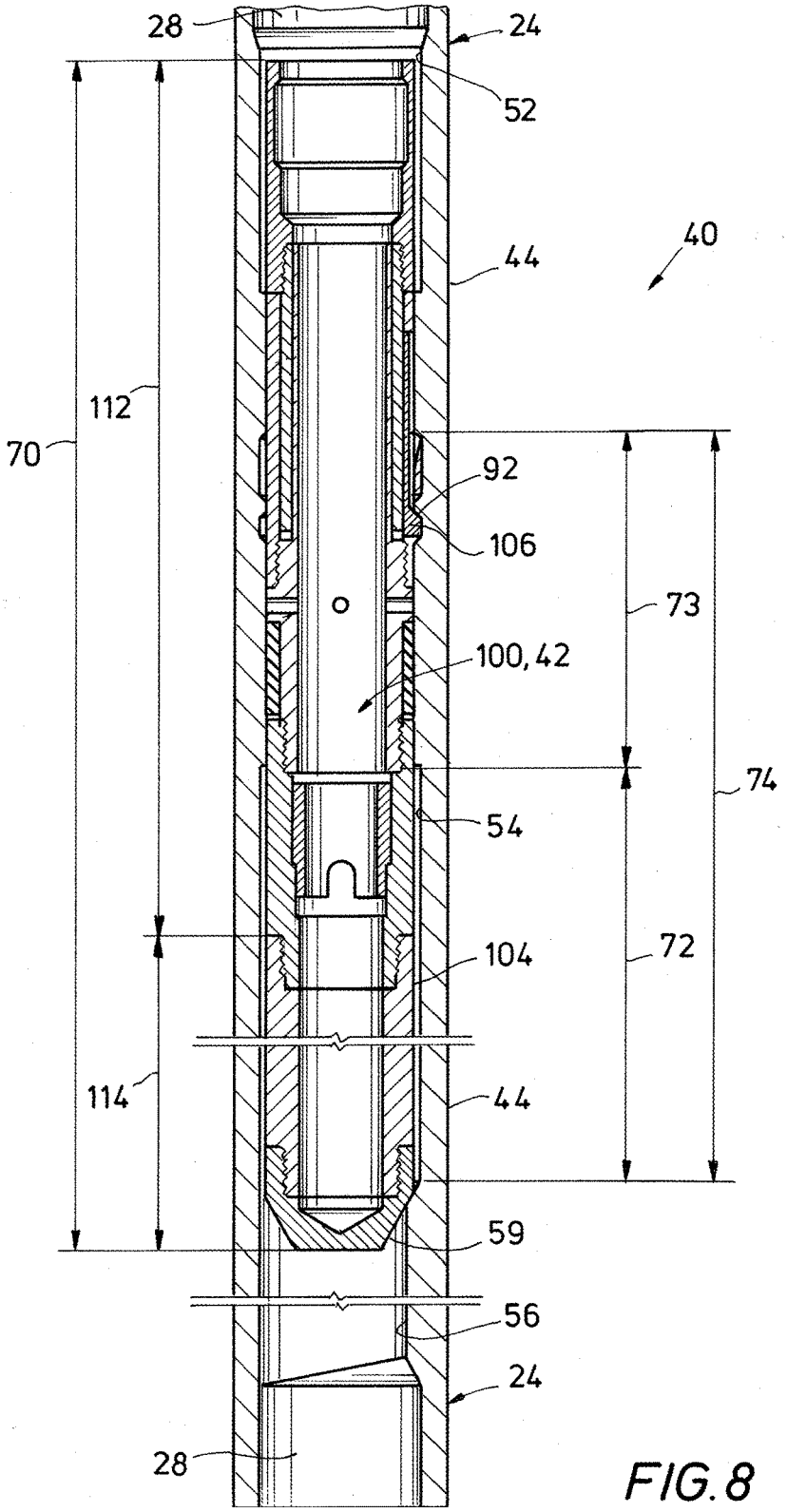

FIGS. 6-8 depict a similar sequence as shown in FIGS. 3A, 4 and 5, but the isolation device 42 of FIGS. 6-8 is shown as a lock mandrel 100. The lock mandrel 100 can include two or more length modules 102, 104 to provide varied lengths of the lock mandrel 100. The module 102 can be a standard length module that can include other downhole tools (e.g., sensors, electronics, etc.) with a length 112. The module 104 can be a variable length module with a length 114. The length 114 can be determined by a single module 104 that is manufactured to different lengths 114, or the length 114 can be determined by connecting together various modules 104 to achieve different lengths 114. The modules 102, 104 are connected together to provide a lock mandrel with an overall length 70 (i.e., combined lengths 112, 114). However, the lock mandrel 100 can be made as a single module 102 with an overall variable length 70, without using a separate variable length module 104.

FIG. 6 depicts a short lock mandrel (i.e., the length 70 is less than the no-go length 74) that has fully exited the entry bore 52 prior to engaging the no-go surface 58 of the isolation mandrel 44 with the surface 59 on the lock mandrel 100. Therefore, the lock mandrel 100 is allowed to radially shift (arrow 46) in the transition chamber 50 to align the lock mandrel 100 with the radially offset exit bore 56 and then exit the transition chamber 50 through the exit bore 56 to continue on to the next isolation mandrel 44 in the tubing string 24. The downstream position of the lock mandrel in the exit bore 56 is depicted in FIG. 7.

FIG. 8 depicts a long lock mandrel 100 (i.e., length 70 is equal to or greater than the no-go length 74) that has engaged the no-go surface 58 of the isolation mandrel 44 with the surface 59 on the lock mandrel 100. Therefore, the lock mandrel 100 is landed (or is a no-go) in the isolation mandrel 44. The engagement between the no-go surface 58 and the surface 59, 1) prevents further displacement in the downstream direction, 2) prevents the long lock mandrel 100 from fully exiting the entry bore 52, and 3) prevents the lock mandrel 100 from being able to shift radially in the transition chamber 50 and realigning with the exit bore 56. Therefore, the seal 90 remains engaged with the entry bore 52 and fluid flow through the isolation mandrel 44 is prevented. When the lock mandrel 100 is landed in the isolation mandrel 44, the lock mandrel 100 can then be activated (via pressure signal, telemetry commands, wire line or coiled tubing manipulations, etc.) to extend the engagement device 106 into engagement with the landing nipple 92, thereby preventing displacement of the lock mandrel in either upstream or downstream longitudinal directions.

It should be understood that the lengths of the transition chambers along with the lengths of the isolation devices can be selected to create a multitude of wellbore intervals within the wellbore. The lengths can vary and be selected in order to create the desired number of wellbore intervals and the number will not be limited by the inner diameter of the tubing string. Therefore, the possibilities and exact configurations are virtually endless.

A method for selective isolation of multiple wellbore intervals can include determining the desired lengths 71 of the multiple isolation mandrels 44 to be interconnected in the tubing string 24, and determining the lengths 70 of the associated isolation devices 42, such that the appropriate isolation device 42 will land in its associated (or paired) isolation mandrel 44 when the isolation devices 42 are displaced through the tubing string 24, thereby providing isolation of multiple wellbore intervals in a desired sequence.

The method can include installing the tubing string 24 in the wellbore 11, with the multiple isolation mandrels positioned at their respective desired locations in the wellbore 11. The tubing string 24 can be secured in the wellbore 11 by setting packers against a casing string or an open hole section of the wellbore 11, or by cementing the tubing string 24 in the wellbore, or etc.

The method can include displacing a first isolation device 42 with a length 70 through the tubing string to it associated isolation mandrel 44 with a no-go length 74 that is shorter than its length 70, where the isolation device will land (or no-go) in the associated isolation mandrel 44. The landed isolation device 42 will prevent fluid flow through the associated isolation mandrel 44, thereby isolating the wellbore intervals that are downstream of the associated isolation mandrel 44 from the wellbore intervals that are upstream of the associated isolation mandrel 44.

The method can include performing various completions operations on one or more of the upstream wellbore intervals, without affecting the downstream wellbore intervals.

The method can include removing the isolation device 42 by retrieval and/or removal (such as breaking, dissolving, degrading, etc.). However, it is not required to remove the isolation device 42. If the desired sequence is to land isolation devices 42 in the farthest downhole isolation mandrel 44 first and then successively land isolation devices 42 in successive upstream isolation mandrels 44, the isolation devices 42 will not need to be removed and can remain in the tubing string 24.

The method can include moving the next isolation device 42 through the tubing string 24 to its associated isolation mandrel 44, and landing the next isolation device 42 in its associated isolation mandrel 44 to isolate wellbore intervals upstream and downstream of the associated isolation mandrel.

The method can include repeating the performing completion operations, removing the isolation device, and moving the next isolation device through the tubing string until all wellbore intervals operations are complete.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a well screen. By way of another example, cement can be used instead of packers 26 to aid the isolation device in providing zonal isolation.

Therefore, the present system is well adapted to attain the ends and advantages mentioned as well as those that are inherent therein. The particular embodiments disclosed above are illustrative only, as the principles of the present disclosure can be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above can be altered or modified and all such variations are considered within the scope and spirit of the principles of the present disclosure.

While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that can be incorporated herein by reference, the definitions that are consistent with this specification should be adopted.

What is claimed is:

1. A system for selective isolation of multiple wellbore intervals, the system comprising:

an isolation mandrel interconnected in a tubing string, wherein the isolation mandrel includes:

an entry bore, a transition chamber, and an exit bore, wherein the transition chamber is positioned between the entry and exit bores, wherein the transition chamber is radially enlarged relative to the entry and exit bores; and an isolation device that is displaced through the tubing string into the isolation mandrel, the isolation device having a predetermined length; wherein the isolation device displaces through the entry bore into the transition chamber and from the transition chamber into the exit bore when the predetermined length of the isolation device is less than a no-go length of the isolation mandrel, wherein the no-go length is a combined longitudinal length of the transition chamber and a portion of an end of the entry bore proximate the transition chamber.

2. The system according to claim 1, wherein the entry bore has a longitudinal axis that is radially offset from a longitudinal axis of the exit bore.

3. The system according to claim 1, wherein the isolation device selectively prevents fluid flow between a first wellbore interval and a second wellbore interval based on the predetermined length.

4. The system according to claim 1, wherein the isolation device is radially displaced in the transition chamber to align with the exit bore.

5. The system according to claim 1, wherein the isolation device displaces through the entry bore into the transition chamber and into engagement with a no-go surface of the isolation mandrel when the predetermined length is equal to or greater than a no-go length of the isolation mandrel, wherein at least a portion of the no-go surface is radially offset from the entry bore, and wherein the no-go length is a combined longitudinal length of the transition chamber and a portion of an end of the entry bore proximate the transition chamber.

6. The system according to claim 5, wherein the engagement with the no-go surface prevents the isolation device from exiting the entry bore, and wherein the isolation device sealingly engages the entry bore, and thereby prevents fluid flow between a first wellbore interval and a second wellbore interval.

7. The system according to claim 1, wherein the isolation device is at least one of a group consisting of a plug, a bridge plug, a wiper plug, a frac plug, a packer, and a lock mandrel.

8. The system according to claim 1, wherein the isolation device is a lock mandrel, and the lock mandrel prevents fluid flow between a first wellbore interval and a second wellbore interval when the lock mandrel is prevented from passing through the isolation mandrel.

9. The system according to claim 8, wherein the lock mandrel is actuated into engagement with a landing nipple in the entry bore in response to engagement of the lock mandrel with a no-go surface in the isolation mandrel, and wherein at least a portion of the no-go surface is radially offset from the entry bore.

10. The system according to claim 8, wherein the lock mandrel includes a standard length module and a variable length module, and the predetermined length is determined by combining the lengths of the standard length module and the length of the variable length module.

11. The system according to claim 1, wherein the isolation mandrel includes a first isolation mandrel and a second isolation mandrel, the first and second isolation mandrels being longitudinally spaced apart in the wellbore, with the first isolation mandrel having a first length and the second isolation mandrel having a second length, and wherein the first and second lengths are different.

12. The system according to claim 11, wherein the first and second isolation mandrels have a minimum inner diameter that is substantially the same.

13. The system according to claim 11, wherein the first isolation mandrel permits displacement of the isolation device through the first isolation mandrel when the first length of the first isolation mandrel is greater than or equal to the predetermined length of the isolation device.

14. The system according to claim 11, wherein the second isolation mandrel prevents displacement of the isolation device through the second isolation mandrel when the second length of the second isolation mandrel is less than the predetermined length of the isolation device, and further displacement of the isolation device is prevented based on the predetermined length of the isolation device.

15. A method of selectively performing a wellbore operation within a wellbore interval, the method comprising:

interconnecting an isolation mandrel in a tubing string, the isolation mandrel including:

an entry bore, a transition chamber, and an exit bore, wherein the transition chamber is positioned between the entry and exit bores, and wherein the transition chamber is radially enlarged relative to the entry and exit bores;

displacing an isolation device into the isolation mandrel, the isolation device having a predetermined length; and selectively permitting and preventing displacement of the isolation device through the isolation mandrel based on the predetermined length of the isolation device.

16. The method according to claim 15, wherein the step of displacing further comprises displacing the isolation device through the isolation mandrel which includes radially displacing the isolation device within the transition chamber, thereby aligning a longitudinal axis of the isolation device with a longitudinal axis of the exit bore, and wherein the longitudinal axis of the exit bore is radially offset from a longitudinal axis of the entry bore.

17. The method according to claim 15, wherein the step of displacing further comprises displacing the isolation device into engagement with a no-go surface in the isolation mandrel and preventing further displacement of the isolation device in response to the engagement, wherein the isolation device extends from the no-go surface, through the transition chamber and at least partially into the entry bore.

18. The method according to claim 17, further comprising performing at least one operation on at least one wellbore interval that is located upstream of the isolation device when the isolation device is engaged with the no-go surface, wherein the operation is selected from the group consisting of a well treatment operation, an injection operation, a fracturing operation, a well test operation, and a fluid production operation.

19. The method according to claim 15, further comprising multiple isolation devices and multiple isolation mandrels, wherein each of the isolation devices have different predetermined lengths, and wherein the length of the transition chamber of each of the isolation mandrels determines which of the isolation devices will engage a no-go surface within a particular isolation mandrel, thereby preventing fluid flow through the respective isolation mandrel and which of the isolation devices will pass through a particular isolation mandrel.

20. A wellbore isolation tool for creating at least one wellbore interval, the tool comprising:

an isolation mandrel comprising:

an entry channel, a transition chamber, and an exit channel, wherein the transition chamber is positioned between the entry and exit channels, and wherein an inner diameter of the transition chamber is greater than a minimum inner diameter of the entry and exit channels; and an isolation device that is displaced through the entry channel and at least partially into the transition chamber, wherein the isolation device selectively permits and prevents fluid flow through the isolation mandrel based on a length of the isolation device; wherein the isolation device displaces through the exit channel when the length of the isolation device is less than a length of the transition chamber.

21. The tool according to claim 19, wherein the isolation device engages a no-go surface at an entrance of the exit channel when the length of the isolation device is greater than a combined longitudinal length of the transition chamber and a portion of an end of the entry channel proximate the transition chamber, and wherein the isolation device is prevented from exiting the entry channel in response to the engagement of the no-go surface.

22. The tool according to claim 19, wherein the isolation device is a lock mandrel, and the lock mandrel engages a no-go surface at an entrance of the exit channel and engages a landing nipple in the entry channel when the length a combined longitudinal length of the transition chamber and a portion of an end of the entry channel proximate the transition chamber length of the transition chamber.

* * * * *